US005927643A

United States Patent [19]

Figge, Sr.

[11] Patent Number: 5,927,643

[45] Date of Patent: Jul. 27, 1999

[54] SELF-DEPLOYING AIRFOIL FOR MISSILE OR THE LIKE

[75] Inventor: Irving E. Figge, Sr., Manssas, Va.

[73] Assignee: Atlantic Research Corporation, Gainesville, Va.

[21] Appl. No.: 08/964,856

[22] Filed: Nov. 5, 1997

Related U.S. Application Data

[51] Int. Cl.[6] ..... F42B 10/00

[52] U.S. Cl. ..... 244/3.27; 244/3.24

[58] Field of Search ..... 244/3.29, 3.3, 244/3.27, 3.28, 3.24, 3.25, 3.26; 102/517, 201

[56] References Cited

U.S. PATENT DOCUMENTS

| | | | |
|---|---|---|---|
| D. 194,647 | 2/1963 | Brown . | |
| D. 220,588 | 4/1971 | Holmes . | |
| 3,081,703 | 3/1963 | Kamp et al. . | |
| 3,103,886 | 9/1963 | Popenoe . | |
| 3,185,412 | 5/1965 | Rogallo . | |
| 3,188,957 | 6/1965 | Petre | 244/3.27 |
| 3,194,514 | 7/1965 | Rogallo . | |
| 3,197,158 | 7/1965 | Rogallo . | |
| 3,374,969 | 3/1968 | Rhodes | 244/3.27 |
| 3,861,627 | 1/1975 | Schoffl . | |
| 4,485,991 | 12/1984 | Fuller . | |
| 4,667,899 | 5/1987 | Wedertz . | |
| 4,709,877 | 12/1987 | Goulding . | |
| 4,736,909 | 4/1988 | Boder et al. | 244/3.29 |
| 4,752,052 | 6/1988 | Galvin . | |
| 4,796,835 | 1/1989 | Galvin | 244/3.29 |
| 4,838,502 | 6/1989 | Pinson . | |
| 4,869,442 | 9/1989 | Miller . | |
| 5,106,034 | 4/1992 | Yagla et al. | 244/3.24 |
| 5,211,358 | 5/1993 | Bagley . | |
| 5,326,049 | 7/1994 | Rom et al. . | |
| 5,417,393 | 5/1995 | Klestadt | 244/3.27 |
| 5,642,867 | 7/1997 | Klestadt | 244/3.27 |

FOREIGN PATENT DOCUMENTS

| | | | |
|---|---|---|---|
| 448437 | 9/1991 | European Pat. Off. | 244/3.29 |
| 1490554 | 6/1967 | France | 244/3.29 |

*Primary Examiner*—Charles T. Jordan
*Assistant Examiner*—Theresa M. Wesson
*Attorney, Agent, or Firm*—Sixbey, Friedman, Leedom & Ferguson; Frank P. Presta; Joseph S. Presta

[57] ABSTRACT

A self-deploying airfoil for a missile or the like of the type that is launched from a launch tube, the airfoil being formed of a flexible and resilient material and being movable by its own resilience from a stowed position in close proximity to the exterior surface of the missile when it is in the launch tube to a deployed position when the missile leaves the launch tube wherein it extends outwardly from the missile to provide lift and stabilize the flight of the missile. The airfoil comprises in its deployed position a first panel extending laterally outwardly from both sides of the missile and being secured at its midportion to an adjacent exterior surface of the missile, a pair of second panels secured at their outer ends to the outer end of the first panel and extending inwardly toward the missile, and a third panel secured at its midportion to an adjacent exterior surface of the missile opposite the first panel. The third panel extends laterally outwardly from both sides of the missile and is connected to the inner ends of the second panels. The third panel has end portions in engagement with the first panel to stabilize the airfoil. In the stowed position of the airfoil, the first panel is folded over the second panels which are, in turn, folded over the third panel in close proximity to the exterior surface of the missile to enable it to be positioned in the launch tube.

13 Claims, 2 Drawing Sheets

SELF-DEPLOYING AIRFOIL FOR MISSILE OR THE LIKE

BACKGROUND OF THE INVENTION

The present invention relates to a self-deploying airfoil for a missile or the like and, more particularly, a flexible and resilient airfoil that is foldable on itself in close proximity to the missile in a stowed position so that it may be received in a launch tube or the like.

Improved missile performance, range and payload are achieved through the use of an airfoil on a missile or the like. In cases where the missile is launched from a launch tube, it is necessary that the airfoil be stowed in close proximity to the missile so that it can be received in the launch tube. When the missile is launched, the airfoil must be constructed so that it is deployed after the missile leaves the launch tube.

Up to the present time, various types of deployable airfoils for missiles or the like have been utilized. While they have generally served the purpose, they have been subject to one or more of the following disadvantages:

1. They have been complicated in construction;
2. They have been unreliable in operation;
3. They have required modifications to the missile which reduce the structural integrity or payload capacity thereof;
4. They have been expensive to manufacture; and/or
5. They have taken up too much space in their stowed position so as to make it difficult to load the missile in a launch tube; and/or
6. The airfoil is not sufficiently rigid when deployed and thus cannot handle high speed flight and/or aerothermal heating.

SUMMARY OF THE INVENTION

The self-deploying airfoil of the present invention is not subject to any of the above listed disadvantages and fills the need for a simple, inexpensive and reliable self-deploying airfoil and lifting body for a missile or the like which presents a minimum amount of air drag when in the deployed position.

This is accomplished by providing an airfoil formed of a thin, flexible and resilient material. In the stowed position, the airfoil is folded or collapsed on itself in a generally circular configuration closely surrounding the missile so that it may be received in and launched from a generally circular launch tube with minimal drag during launch prior to deployment. After the missile leaves the launch tube, the airfoil deploys or opens to provide a lifting body for the missile. The airfoil is self-deploying because it is made from flexible and resilient material and uses the spring energy stored during stowing to effect deployment.

DRAWINGS

Figure 4:
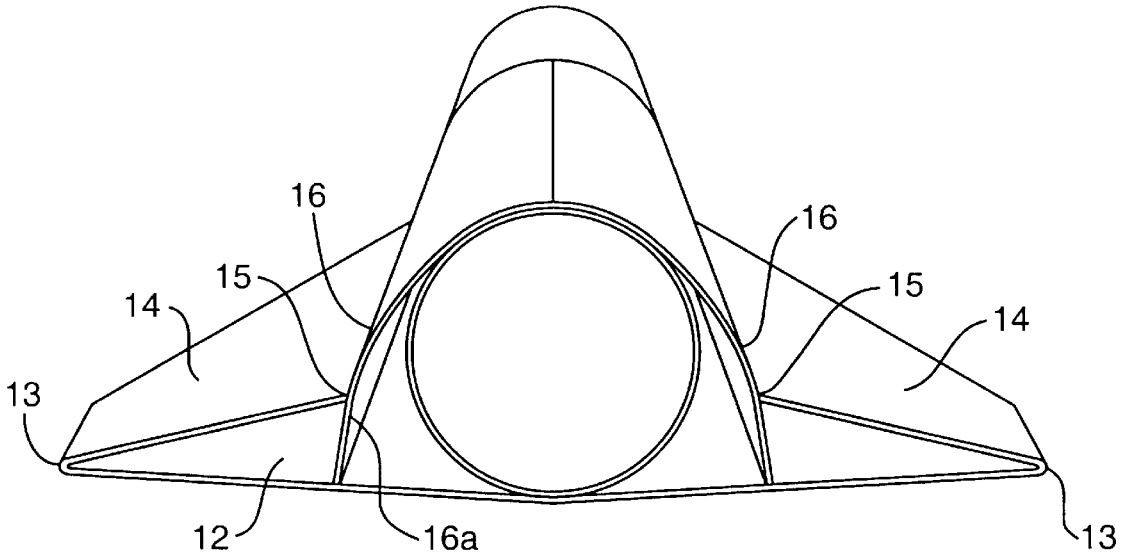
FIG. 4 shows a rear view of the missle of FIG. 1.
Figure 5A:
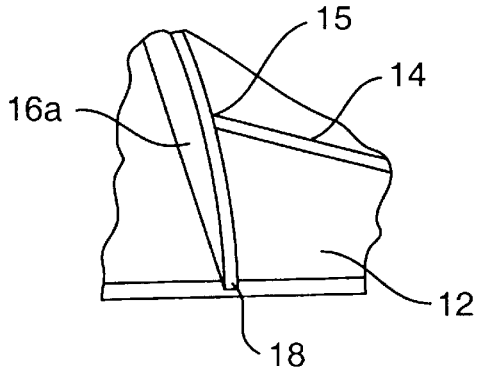
Figure 5B:
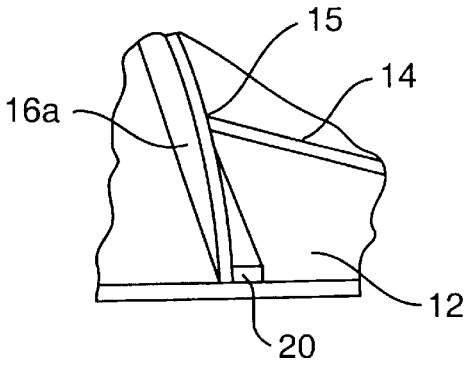

FIGS. 5*a* and 5*b* show alternative exemplary embodiments of a rear section of the missile of FIG. 4.

DESCRIPTION OF THE PREFERRED EMBODIMENTS

Figure 1:
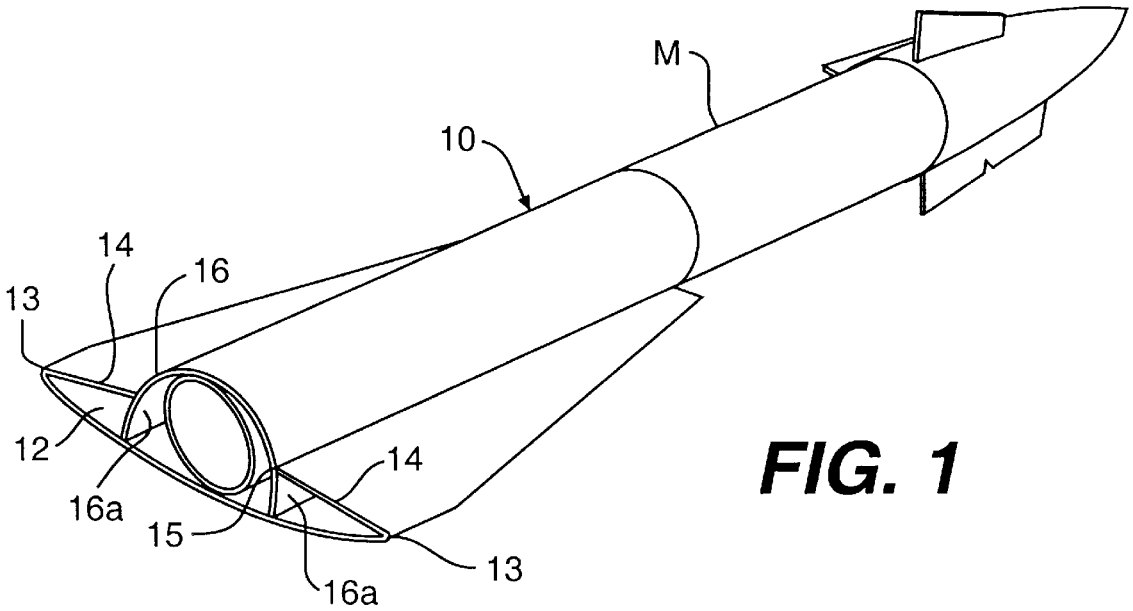
FIG. 1 is a perspective view of a missile with the airfoil of the present invention in a deployed position after launch.

As shown in FIG. 1, the airfoil 10 of the present invention is mounted on a missile M or other projectile of the type to be launched from a launch tube or the like. The airfoil 10 is shown in a deployed position wherein it is substantially rigid and provides lift and stability to the missile after launch and during flight thereof.

The airfoil 10 may be formed of any suitable spring-type or flexible and resilient material, such as a suitable metal or composite material. The airfoil 10 is of generally tapered configuration in its deployed position and extends outwardly from the midportion of the missile towards the rear end thereof to minimize drag during the flight of the missile.

Preferably, the airfoil 10 comprises a first or lower panel 12 that is secured at its midportion in any suitable manner, such as by welding, bonding or mechanical attachment, to the adjacent lower exterior surface of the missile in close contact therewith. The first panel 12 is secured at its outer ends along fold lines 13 to a pair of second or upper side panels 14 extending toward the missile. At their inner ends, the second panels 14 are connected along fold lines 15 to a third or upper midpanel 16 that is secured at its midportion in any suitable manner, such as by welding, bonding or mechanical attachment, in close proximity to the adjacent upper exterior surface of the missile.

The lower ends 16*a* of the third panel 16 extend downwardly into engagement with the adjacent portions of the first panel 12 and are removably retained in position thereon by longitudinal grooves 18 in the first panel into which the ends 16*a* are received, as shown in FIG. 5A. Alternatively, the ends 16*a* could be retained in position by engagement with longitudinal ribs 20 in the first panel, as shown in FIG. 5B. Any other suitable means could be utilized to retain the ends 16*a* in position. In this manner, the lower ends 16*a* of the third panel 16 serve as stabilizing members for the airfoil 10 when in the deployed position.

Figure 2:
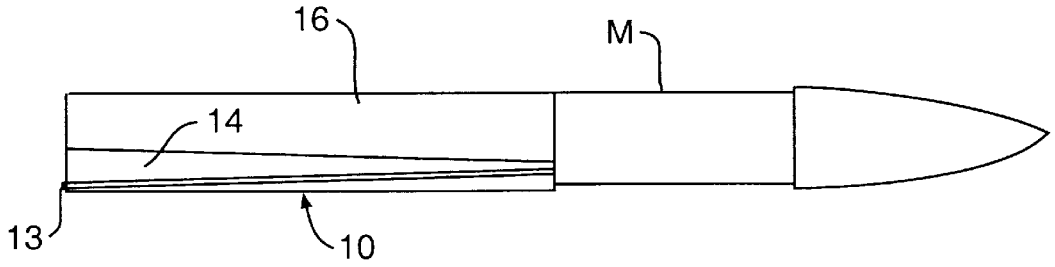
FIG. 2 is a side elevational view of the missile shown in FIG. 1 wherein the airfoil is in the deployed position.

In a preferred embodiment, the first panel 12, second panels 14 and third panel 16 are integrally formed of unitary construction of a spring-type or flexible and resilient material such that they are normally in the deployed position shown in FIGS. 1 and 2. Also, the first, second and third panels preferably are curved in the same direction as the adjacent exterior surface of the missile. As shown in FIG. 2, the upper and lower surfaces of the airfoil 10 are in close proximity to the missile such that, in the deployed position, the airfoil extends laterally outwardly generally within the upper and lower surfaces of the missile so as to minimize drag during launch and flight of the missile.

Although it is preferred to form the airfoil 10 of unitary construction, it would be possible to form the panels 12, 14 and 16 separately and to secure them together in any well known manner within the teachings of the present invention. Also, the airfoil 10 could be formed of two mating lateral sections which are secured to the upper and lower surfaces of the missile instead of being formed of unitary construction.

Figure 3:
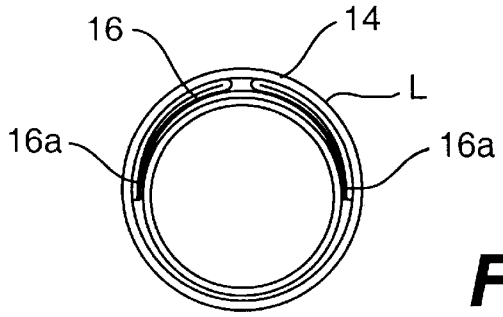
FIG. 3 is an end elevational view showing the airfoil in a stowed position in close proximity to the missile when it is in a launch tube.

As shown in FIG. 3, the airfoil 10 in the stowed position is collapsed or folded on itself in a generally circular configuration in close proximity to the outer surface of the missile M when it is inserted in the launch tube L. In the stowed position, the third or upper midpanel 16 and the lower ends 16*a* thereof are folded downwardly and inwardly in one direction into engagement with the adjacent upper exterior surface of the missile, and the first or lower panel 12 and second or upper side panels 14 are folded upwardly and inwardly in the opposite direction along the fold lines 13, 15 in a curved configuration surrounding the third or upper midpanel 16 in close proximity to the exterior curved surface of the missile M such that the connected outer end portions of the first panel 12 and second panels 14 are in close proximity to each other on the upper side of the missile, as shown in FIG. 3. In the stowed position, therefore, the first panel 12 overlies the second panels 14 which in turn overlie the third panel 16 such that the fold lines 13 are disposed in close relation in the manner shown in FIG. 3.

In operation, prior to launch the missile M is in the launch tube L wherein the airfoil 10 is in the stowed position shown in FIG. 3. When the missile M is launched and leaves the launch tube L, the flexible and resilient material of the airfoil 10 causes it to deploy to the position shown in FIGS. 1 and 2 wherein it provides lift and stability for the missile with minimum drag because of its tapered configuration and minimal height. The deployment can be delayed to a predetermined time after launch and during missile flight with the use, for example, of a simple band strap (not shown) or the like and a time/altitude or radio-controlled release mechanism (not shown).

Various modifications, alterations, changes and additions can be made in the improved self-deploying airfoil of the present invention, its components and parameters. All such modifications, changes, alterations and additions which are within the scope of the appended claims form part of the present invention.

What is claimed is:

1. A self-deploying airfoil for a missile launched from a launch tube, said airfoil being formed of flexible and resilient material and being movable by the airfoil's own resilience from a stowed position in close proximity to the outer surface to the missile when the missile is in the launch tube to a deployed position after the missile leaves the launch tube wherein said airfoil extends outwardly from the missile to provide lift and stabilize the flight of the missile, said airfoil in said deployed position being of tapered configuration extending outwardly toward the rear of the missile and comprising:

a first panel extending laterally outwardly from both sides of the missile and being secured at the first panel's midportion to an adjacent first exterior surface of the missile, a pair of second panels secured at the second panels' outer ends to the outer ends of said first panel and extending inwardly toward the missile, and a third panel secured at a midportion of the third panel to an adjacent second exterior surface of the missile that is substantially opposite to said first exterior surface thereof, said third panel extending laterally outwardly from both sides of the missile and being connected to the inner ends of said second panels, said third panel having end portions in engagement with said first panel to stabilize said airfoil in said deployed position, whereby in said stowed position of said airfoil said third panel is folded in one direction into close engagement with the second adjacent exterior surface of the missile, said second panels are folded in an opposite direction into close surrounding engagement with the outer surface of said third panel, and said first panel is folded in said opposite direction into close surrounding engagement with said second panels and said third panel; said first, second and third panels being folded into a configuration that is complementary to the outer surface of the missile when in said stowed position.

2. The self-deploying airfoil of claim 1 wherein said first panel, said second panels and said third panel are of curved configuration when said airfoil is in said deployed position.

3. The self-deploying airfoil of claim 2 wherein said first panel, said second panels and said third panel are in a substantially circular configuration when in said stowed position.

4. The self-deploying airfoil of claim 2 wherein said first panel is curved in the same direction as said adjacent first exterior surface of the missile, and said third panel is curved in the same direction as said adjacent second exterior surface of the missile.

5. The self-deploying airfoil of claim 1 wherein said first panel, said second panels and said third panel are integrally formed of unitary construction.

6. The self-deploying airfoil of claim 1 wherein the front portion of the airfoil is disposed in close proximity with a midportion of the missile and the rear portion of the airfoil extends laterally outwardly from the rear portion of the missile.

7. The self-deploying airfoil of claim 6 wherein said first panel, said second panels and said third panel, when in said deployed position, are disposed substantially between said first and second exterior surfaces of the missile so as to minimize drag during the flight of the missile.

8. The self-deploying airfoil of claim 1 wherein said first panel, said second panels and said third panel are connected to each other along fold lines in said airfoil.

9. The self-deploying airfoil of claim 8 wherein said airfoil is formed of metal.

10. The self-deploying airfoil of claim 8 wherein said airfoil is formed of a composite material.

11. The self-deploying airfoil of claim 1 wherein said first panel has means thereon for retaining said end portions of said third panel in predetermined positions thereon for stabilizing said airfoil.

12. The self-deploying airfoil of claim 11 wherein said retaining means comprises longitudinal grooves on the surface of said first panel adjacent said third panel, and said end portions of said third panel are received in said grooves to retain the end portions in position on said first panel.

13. The self-deploying airfoil of claim 11 wherein said retaining means comprises longitudinal ribs on the surface of said first panel adjacent said third panel, and said end portions of said third panel are in engagement with said ribs to retain them in position on said first panel.

* * * * *